US008735034B2

(12) United States Patent
Yamazaki et al.

(10) Patent No.: US 8,735,034 B2
(45) Date of Patent: May 27, 2014

(54) TONER FOR ELECTROSTATIC IMAGE DEVELOPMENT

(75) Inventors: Masahito Yamazaki, Wakayama (JP); Satoshi Kunii, Wakayama (JP)

(73) Assignee: Kao Corporation, Tokyo (JP)

( * ) Notice: Subject to any disclaimer, the term of this patent is extended or adjusted under 35 U.S.C. 154(b) by 52 days.

(21) Appl. No.: 13/309,731

(22) Filed: Dec. 2, 2011

(65) Prior Publication Data

US 2012/0156602 A1 Jun. 21, 2012

(30) Foreign Application Priority Data

Dec. 20, 2010 (JP) ..... 2010-283520

(51) Int. Cl.
*G03G 9/087* (2006.01)

(52) U.S. Cl.
USPC ..... 430/108.6; 430/108.7; 430/109.4; 430/123.51; 430/124.4

(58) Field of Classification Search
USPC ..... 430/108.6, 108.7, 109.4, 123.51, 124.4
See application file for complete search history.

(56) References Cited

U.S. PATENT DOCUMENTS

| | | | | |
|---|---|---|---|---|
| 6,077,639 | A * | 6/2000 | Semura et al. | 430/109.4 |
| 2004/0043320 | A1 * | 3/2004 | Naito et al. | 430/111.33 |
| 2008/0012926 | A1 * | 1/2008 | Hara et al. | 347/158 |
| 2010/0009282 | A1 * | 1/2010 | Katoh et al. | 430/124.1 |
| 2010/0075242 | A1 | 3/2010 | Kunii et al. | |
| 2010/0330493 | A1 | 12/2010 | Kaneeda et al. | |

FOREIGN PATENT DOCUMENTS

| | | | | |
|---|---|---|---|---|
| JP | 2001-51448 | | 2/2001 | |
| JP | 2002-182424 | | 6/2002 | |
| JP | 2002162789 | A * | 6/2002 | G03G 9/113 |
| JP | 2004-177747 | | 6/2004 | |
| JP | 2010-20024 | | 1/2010 | |
| JP | 2010-72569 | | 4/2010 | |
| WO | WO 2009/084184 | A1 | 7/2009 | |

OTHER PUBLICATIONS

English language machine translation of JP 2002-162789 (Jun. 2002).*

Borsenberger, Paul M. and David S. Weiss. Organic Photoreceptors for Imaging Systems. New York: Marcel-Dekker, Inc. (1993) pp. 6-17.*

U.S. Appl. No. 13/309,921, filed Dec. 2, 2011, Kunii, et al.

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A toner for electrostatic image development containing toner matrix particles having at least a resin binder and a colorant, and an external additive, the external additive having composite oxide particles (an external additive A) that have titania and silica, wherein the external additive A has a core-shell structure in which a core portion has the titania and a shell portion has the silica, wherein the titania is present in the external additive A in an amount of from 75 to 95% by weight, and the resin binder comprising a polyester obtained by polycondensing a carboxylic acid component comprising an isophthalic acid compound and an alcohol component (a polyester A).

16 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like, a two-component developer using the toner, and a method of forming fixed images using the toner and the two-component developer.

BACKGROUND OF THE INVENTION

With the demands in speeding-up, miniaturization or the like of copy machines and laser printers in the recent years, various external additives are used for the purpose of improving fluidity or triboelectric chargeability of a toner.

For example, JP-A-2010-20024 (US-A-2010-009282) discloses that a toner containing a composite oxide having a core-shell structure in which a core portion contains titanium oxide and a shell portion contains silicon oxide, wherein titanium oxide is contained in an amount of from 80 to 95% by weight serves to suppress background fogging or soiling of a charging roller.

JP-A-2002-182424 discloses that a toner containing fine metal oxide particles having a core-shell structure in which a core layer is made of a metal oxide selected from titanium dioxide, aluminum oxide, and zinc oxide, and a shell layer is made of silica, the fine metal oxide particles having an average particle size of from 10 to 30 nm and a degree of sphericity of from 1 to 1.3 is free from background fogging, faded print, and filming and the like, and has excellent durability, thereby exhibiting a high optical density.

JP-A-2004-177747 discloses that a toner containing silica-coated metal oxide particles having a core-shell structure in which a core layer is made of a metal oxide selected from titanium dioxide, aluminum oxide, and zinc oxide, and a shell layer is made of silica, and fine silica particles having a volume-average particle size of from 5 to 20 nm, has excellent cleanability and gives excellent image quality.

WO 2009/084184 (US-A-2010-330493) discloses that a toner containing surface-modified, fine composite oxide particles comprising silica-titania composite oxide particles produced by a vapor phase method, subjected to a surface treatment has a small change in triboelectric charges with the passage of time.

JP-A-2010-72569 (US-A-P2010-075242) discloses that a toner containing a resin binder containing a polyester obtained by polycondensing an alcohol component and a carboxylic acid containing isophthalic acid, and an external additive containing fine silica particles containing a metal or a metal oxide has excellent durability and triboelectric chargeability, so that stable fixed images are obtained for a long period of time.

JP-A-2001-51448 discloses that a toner containing a polyester resin containing a composition having an acid value of 6 mgKOH/g or more, and containing isophthalic acid in an amount of from 25 to 50% by mol, and terephthalic acid in an amount of 8% by mol or less, has excellent low-temperature fixing properties, has little generation of fusion to a developer roller and a blade, scattering, background fogging, or the like in long-term continuous copying, and can realize stabilized image properties.

SUMMARY OF THE INVENTION

The present invention relates to:

[1] a toner for electrostatic image development containing toner matrix particles containing at least a resin binder and a colorant, and an external additive, the external additive containing composite oxide particles (an external additive A) made of titania and silica, wherein the external additive A has a core-shell structure in which a core portion is made of titania and a shell portion is made of silica, wherein the titania is contained in the external additive A in an amount of from 75 to 95% by weight, and the resin binder containing a polyester obtained by polycondensing a carboxylic acid component containing an isophthalic acid compound and an alcohol component (a polyester A);

[2] a two-component developer containing a toner for electrostatic image development as defined in the above [1] and a carrier; and

[3] a method for forming fixed images including the step of applying a toner for electrostatic image development as defined in the above [1], or a two-component developer as defined in the above [2], to an apparatus for forming fixed images according to a hybrid development method.

DETAILED DESCRIPTION OF THE INVENTION

In copy machines and laser printers which are speeded up and miniaturized, it is insufficient in a conventional toner in coping with a disadvantage that a photoconductor is worn off when subjected to continuous printing for a long period of time.

The present invention relates to a toner capable of suppressing the photoconductor abrasion, even when subjected to continuous printing for a long period of time, a two-component developer using the toner, and a method of forming fixed images using the toner and the two-component developer.

The toner for electrostatic image development and the two-component developer containing the toner of the present invention exhibit an effect of suppressing the photoconductor abrasion even when subjected to continuous printing for a long period of time.

These and other advantages of the present invention will be apparent from the following description.

The toner for electrostatic image development of the present invention is a toner containing toner matrix particles containing at least a resin binder and a colorant, and an external additive, the external additive containing composite oxide particles (an external additive A) made of titania and silica, wherein the external additive A has a core-shell structure in which a core portion is made of titania and a shell portion is made of silica, wherein the titania is contained in the external additive A in an amount of from 75 to 95% by weight, and the above resin binder containing a polyester obtained by polycondensing a carboxylic acid component containing an isophthalic acid compound, and an alcohol component (a polyester A).

Although not wanting to be limited by theory, while the reasons why the toner exhibits the effects of suppressing the photoconductor abrasion are not elucidated, they are considered to be as follows.

If an isophthalic acid-based polyester is used, low molecular components are reduced, so that an external additive is suppressed from being embedded into toner matrix particles, thereby improving image stability such as optical density during durability printing test, but meanwhile making it more likely to generate photoconductor abrasion.

An external additive A is composite oxide particles that have a core-shell structure in which the titania constitutes a core, and the silica constitutes a shell. In general, while titania has a lower volume resistance than silica, the external additive A has a volume resistance that is high even though a titanium content is high because titania is hardly present on the surface of the particles, as compared to composite oxide particles having a non-core-shell structure. Therefore, it is considered that in a toner in which an external additive A is deposited on the surface of toner matrix particles, since triboelectric charges can be maintained at a high level, background fogging caused by the lowering of the triboelectric charges can be suppressed, and mechanical force applied during cleaning can be reduced, so that photoconductor abrasion can be suppressed.

In addition, the external additive A has a volume resistance which is lower than that of silica, thereby suppressing the deposition to the surface of photoconductor caused by electrostatic interactions. Further, the external additive A has a core-shell structure in which the silica is a shell layer, so that the surface of the external additive particles is more easily subjected to a hydrophobic treatment, as compared to composite particles having a non-core-shell structure in which titania is present on the surface of the particles, and by the hydrophobic treatment, deposition to the surface of a photoconductor caused by intermolecular interactions is also suppressed. Therefore, it is considered that a toner in which an external additive A is deposited to the surface of the toner matrix particles has small electrostatic interactions and intermolecular interactions with the photoconductor, thereby suppressing the deposition of the toner on the surface of photoconductor, and suppressing the photoconductor abrasion.

The toner of the present invention is a toner containing toner matrix particles containing at least a resin binder and a colorant, and an external additive.

<Toner Matrix Particles>

[Resin Binder]

The resin binder in the present invention contains a polyester obtained by polycondensing a carboxylic acid component containing an isophthalic acid compound, and an alcohol component (hereinafter referred to as a polyester A).

The isophthalic acid compound refers to at least one compound selected from isophthalic acid, esters of isophthalic acid, and isophthalic anhydride. The esters of isophthalic acid include lower alkyl(1 to 6 carbon atoms) esters thereof, and the like.

The polyester A is obtained by polycondensing a carboxylic acid component containing a dicarboxylic or higher polycarboxylic acid compound containing an isophthalic acid compound, and an alcohol component containing a dihydric or higher polyhydric alcohol. Here, the carboxylic acid compound refers to at least one compound selected from a carboxylic acid, esters of a carboxylic acid, and an acid anhydride of a carboxylic acid. The esters of carboxylic acid include lower alkyl (1 to 6 carbon atoms) esters thereof, and the like.

The isophthalic acid compound is contained in an amount of preferably 55% by mol or more, more preferably 70% by mol or more, even more preferably 90% by mol or more, and even more preferably 95% by mol or more, and even more preferably substantially 100% by mol, of the carboxylic acid component in the polyester A, from the viewpoint of suppressing the embedment of an external additive to toner matrix particles, and preventing the fusion of the toner particles, thereby consequently reducing the deposition of the toner particles to the surface of photoconductor, and suppressing the photoconductor abrasion of the toner during durability printing, and from the viewpoint of suppressing the embedment of an external additive to toner matrix particles, and improving triboelectric stability of the toner, thereby maintaining an optical density during durability printing.

The dicarboxylic acid compound other than the isophthalic acid compound includes, for example, dicarboxylic acids having preferably 3 to 30 carbon atoms, more preferably 3 to 20 carbon atoms, and even more preferably 3 to 10 carbon atoms, derivatives, such as acid anhydrides thereof and alkyl(1 to 8 carbon atoms) esters thereof, and the like. Specific examples include aromatic dicarboxylic acids such as phthalic acid and terephthalic acid; and aliphatic dicarboxylic acids, such as fumaric acid, maleic acid, succinic acid, glutaric acid, adipic acid, sebacic acid, succinic acids substituted with an alkyl group having 1 to 20 carbon atoms or an alkenyl group having 2 to 20 carbon atoms.

The tricarboxylic or higher polycarboxylic acid compound includes, for example, tricarboxylic or higher polycarboxylic acids having preferably 4 to 30 carbon atoms, more preferably 4 to 20 carbon atoms, and even more preferably 4 to 10 carbon atoms, derivatives thereof, such as acid anhydrides thereof and alkyl (1 to 8 carbon atoms) esters thereof, and the like. Specific examples include 1,2,4-benzenetricarboxylic acid (trimellitic acid), 1,2,4,5-benzenetetracarboxylic acid (pyromellitic acid) and the like.

The dihydric alcohol includes, for example, diols having 2 to 20 carbon atoms, and preferably 2 to 15 carbon atoms, an alkylene oxide adduct of bisphenol A represented by the formula (I):

(I)

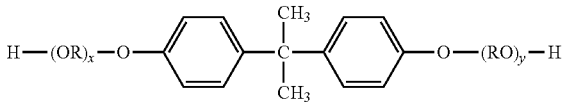

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4; and the like.

Specifically, the diol having 2 to 20 carbon atoms includes ethylene glycol, propylene glycol, 1,4-butanediol, 1,6-hexanediol, bisphenol A, hydrogenated bisphenol A, and the like.

The alcohol component is preferably an alkylene oxide adduct of bisphenol A represented by the formula (I) from the viewpoint of suppressing the embedment of an external additive to toner matrix particles, and preventing fusion of the toner particles, thereby consequently reducing deposition of the toner particles to the surface of photoconductor, and suppressing the photoconductor abrasion of the toner during durability printing, and from the viewpoint of suppressing the embedment of an external additive to toner matrix particles, and improving triboelectric stability of the toner, thereby maintaining an optical density during durability printing. The alkylene oxide adduct of bisphenol A represented by the formula (I) is contained in an amount of preferably 50% by mol or more, more preferably 70% by mol or more, even more preferably 90% by mol or more, and even more preferably substantially 100% by mol, of the alcohol component, from the above viewpoint.

The trihydric or higher polyhydric alcohol includes, for example, trihydric or polyhydric alcohols having 3 to 20 carbon atoms, and preferably 3 to 10 carbon atoms. Specific examples include sorbitol, 1,4-sorbitan, pentaerythritol, glycerol, trimethylolpropane, and the like.

Here, the alcohol component may properly contain a monohydric alcohol, and the carboxylic acid component may properly contain a monocarboxylic acid compound, from the viewpoint of adjusting a softening point of the polyester.

The resin binder used in the present invention may contain a polyester other than the polyester A. The polyester other than the polyester A is obtained by polycondensing a carboxylic acid component not containing an isophthalic acid compound and the above-mentioned alcohol component.

The polyester A is contained in an amount of preferably 15% by weight or more, more preferably 40% by weight or more, even more preferably 70% by weight or more, even more preferably 95% by weight or more, and even more preferably substantially 100% by weight, of all the polyesters in the resin binder, i.e. the polyester A and the polyester other than the polyester A, hereinafter simply referred to as the polyesters, from the viewpoint of suppressing the photoconductor abrasion of a toner during durability printing and maintaining an optical density.

In addition, the isophthalic acid compound is contained in an amount of preferably 5% by weight or more, more preferably 15% by weight or more, and even more preferably 25% by weight or more, of a total amount of the raw material monomers for the polyester, in other words, a total amount of the carboxylic acid component and the alcohol component, from the viewpoint of suppressing the photoconductor abrasion of the toner during durability printing and maintaining an optical density. The isophthalic acid compound is contained in an amount of preferably 70% by weight or less, more preferably 50% by weight or less, and even more preferably 34% by weight or less, of the total amount of the raw material monomers for the polyester, from the same viewpoint. From these viewpoints taken together, the isophthalic acid compound is contained in an amount of preferably from 5 to 70% by weight, more preferably from 15 to 50% by weight, and even more preferably from 25 to 34% by weight, of the total amount of the raw material monomers for the polyester.

The carboxylic acid component and the alcohol component in the polyester are in an equivalent ratio, i.e. COOH group/OH group, of preferably from 0.70 to 1.10, and more preferably from 0.75 to 1.00, from the viewpoint of reducing an acid value of the polyester, reducing a lower molecular weight component of the resin, preventing an external additive from being embedded to toner matrix particles, suppressing the photoconductor abrasion of the toner during durability printing, and maintaining an optical density.

The polycondensation reaction of the alcohol component and the carboxylic acid component can be carried out by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

The polyester has a softening point of preferably 90° C. or higher, more preferably 95° C. or higher, and even more preferably 100° C. or higher, from the viewpoint of preventing embedment of an external additive A into toner matrix particles, suppressing the photoconductor abrasion of the toner during durability printing, and maintaining an optical density. In addition, the polyester has a softening point of preferably 125° C. or lower, more preferably 120° C. or lower, and even more preferably 115° C. or lower, from the viewpoint of improving low-temperature fixing ability of the toner. In other words, from these viewpoints taken together, the polyester has a softening point of preferably from 90° to 125° C., more preferably from 95° to 120° C., and even more preferably from 100° to 115° C. In a case where two or more kinds of polyesters are used, it is preferable that a softening point as an overall polyester falls within the range mentioned above. The softening point of the overall polyester can be obtained by a weighted average, in other words, the sum of the products of each of softening points and the content ratio.

The softening point of the polyester can be controlled by adjusting the kinds and compositional ratios of the alcohol component and the carboxylic acid component, the amount of a catalyst or the like, or selecting reaction conditions such as a reaction temperature, a reaction time, and a reaction pressure.

The polyester has a glass transition temperature preferably 50° C. or higher, and more preferably 55° C. or higher, from the viewpoint of preventing embedment of an external additive into toner matrix particles, suppressing the photoconductor abrasion of the toner during durability printing, and maintaining an appropriate optical density, and from the viewpoint of improving storage stability of the toner. In addition, the polyester has a glass transition temperature of preferably 85° C. or lower, and more preferably 80° C. or lower, from the viewpoint of improving low-temperature fixing ability of the toner. In other words, from these viewpoints taken together, the polyester has a glass transition temperature of preferably from 50° to 85° C., and more preferably from 55° to 80° C. In a case where two or more kinds of polyesters are used, it is preferable that a glass transition temperature as an overall polyester also falls within the range mentioned above. The glass transition temperature of the overall polyester can be obtained by a weighted average, in other words, the sum of the products of each of glass transition temperatures and the content ratio.

The glass transition temperature of the polyester can be controlled by the kinds, compositional ratios of the alcohol component and the carboxylic acid component, and the like.

The polyester has an acid value of preferably 50 mg KOH/g or less, more preferably 30 mg KOH/g or less, and even more preferably 20 mg KOH/g or less, from the viewpoint of reducing a low molecular weight component of the resin, and preventing embedment of an external additive into toner matrix particles, thereby consequently suppressing the photoconductor abrasion of the toner during durability printing, and maintaining an optical density. In a case where two or more kinds of polyesters are used, it is preferable that an acid value as an overall polyester falls within the range mentioned above. The acid value of the overall polyester can be obtained by weighted average, in other words, the sum of the products of each of acid values and the content ratio.

The acid value of the polyester can be controlled by adjusting the kinds and compositional ratios of the alcohol component and the carboxylic acid component, an amount of catalyst or the like, or selecting reaction conditions such as a reaction temperature, a reaction time, and a reaction pressure.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in JP-A-Hei-11-133668, JP-A-Hei-10-239903, JP-A-Hei-8-20636, or the like.

It is preferable to use only a polyester as a resin binder, but the resin binder may contain a resin other than the polyester in an amount within the range that would not impair the effects of the present invention. The other resin binder includes vinyl resins, epoxy resins, polycarbonates, polyurethanes, and the like. In a case where the resin other than the polyester is contained, it is preferable that a softening point and a glass transition temperature as an overall resin binder also fall within the range mentioned above.

The polyester A is contained in an amount of preferably 15% by weight or more, more preferably 40% by weight or more, even more preferably 70% by weight or more, even more preferably 95% by weight or more, and even more preferably substantially 100% by weight, of the resin binder, from the viewpoint of suppressing the photoconductor abrasion of the toner during durability printing and maintaining an optical density.

[Colorant]

As the colorant, all of the dyes, pigments and the like which are used as colorants for toners can be used, and specifically, carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used.

The colorant in the toner matrix particles is contained in an amount of preferably from 1 to 40 parts by weight, and more preferably from 2 to 10 parts by weight, based on 100 parts by weight of the resin binder, from the viewpoint of improving an optical density, and from the viewpoint of economic advantages.

In a case where a black toner is obtained, it is preferable that the colorant is a carbon black, from the viewpoint of easiness in availability.

Since a carbon black has electroconductivity, the carbon black is likely to lower the triboelectric charges of the toner.

The carbon black is contained in the toner matrix particles in an amount of preferably 3 parts by weight or more, more preferably 4 parts by weight or more, and even more preferably 6 parts by weight or more, based on 100 parts by weight of the resin binder, from the viewpoint of suppressing the photoconductor abrasion of the toner during durability printing and from the viewpoint of improving an optical density of the toner. In addition, the carbon black is contained in the toner matrix particles in an amount of preferably 15 parts by weight or less, more preferably 10 parts by weight or less, and even more preferably 8 parts by weight or less, based on 100 parts by weight of the resin binder, from the viewpoint of suppressing the photoconductor abrasion of the toner during durability printing and maintaining an optical density. From these viewpoints taken together, the carbon black is contained in the toner matrix particles an amount of preferably from 3 to 15 parts by weight, more preferably from 3 to 10 parts by weight, even more preferably from 4 to 8 parts by weight, and even more preferably from 6 to 8 parts by weight, based on 100 parts by weight of the resin binder.

In the toner of the present invention, the toner matrix particles may properly contain a releasing agent, a charge control agent, or the like.

[Releasing Agent]

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof, and fatty acid ester waxes; fatty acid amides, higher alcohols, and the like. Among them, the hydrocarbon waxes and the ester waxes are preferred, from the viewpoint of improving low-temperature fixing ability and storage stability of the toner, and from the viewpoint of suppressing the deposition of the toner to a carrier when used as a two-component developer. From the same viewpoint, carnauba wax is preferred among the ester waxes, and polypropylene wax is preferred among the hydrocarbon waxes.

The releasing agent has a melting point of preferably from 60° to 160° C., and more preferably from 70° to 150° C., from the viewpoint of improving low-temperature fixing ability and storage stability of the toner, and from the viewpoint of suppressing the deposition of the toner to a carrier when used as a two-component developer.

The releasing agent in the toner matrix particles is contained in an amount of preferably from 0.5 to 4 parts by weight, and more preferably from 1 to 3 parts by weight, based on 100 parts by weight of the resin binder, from the viewpoint of improving low-temperature fixing ability and storage stability of the toner, and from the viewpoint of suppressing the deposition of the toner to a carrier when used as a two-component developer.

[Charge Control Agent]

As the charge control agent, any one of negatively chargeable charge control agents and positively chargeable charge control agents can be used.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804, "BONTRON S-28," "BONTRON S-31," "BONTRON S-32," "BONTRON S-34," "BONTRON S-36" (hereinabove commercially available from Orient Chemical Co., Ltd.), "T-77," "AIZEN SPILON BLACK TRH" (hereinabove commercially available from Hodogaya Chemical Co., Ltd.), and the like. The metal complexes of alkyl derivatives of salicylic acid include, for example, "BONTRON E-81," "BONTRON E-82," "BONTRON E-84," "BONTRON E-85" (hereinabove commercially available from Orient Chemical Co., Ltd.), and the like. The boron complexes of benzilic acid include, for example, "LR-147" (commercially available from Japan Carlit, Ltd.), and the like. Among them, the metal-containing azo dyes are preferred, from the viewpoint of improving triboelectric stability of the toner, and maintaining an optical density during durability printing.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.), and the like. The triphenylmethane-based dyes include, for example, triphenylmethane-based dyes containing a tertiary amine as a side chain. The quaternary ammonium salt compounds include, for example, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PX VP435," "COPY CHARGE PSY" (hereinabove commercially available from Clariant GmbH), and the like. The polyamine resins include, for example, "AFP-B" (commercially available from Orient Chemical Co., Ltd.), and the like. The imidazole derivatives include, for example, "PLZ-2001," "PLZ-8001" (hereinabove commercially available from Shikoku Kasei K.K.), and the like. Among them, the quaternary ammonium salt compound are preferred, from the viewpoint of improving triboelectric stability of the toner, and maintaining an optical density during durability printing.

The charge control agent in the toner matrix particles is contained in an amount of preferably from 0.5 to 5 parts by weight, and more preferably from 1 to 4 parts by weight, based on 100 parts by weight of the resin binder, from the viewpoint of improving triboelectric stability of the toner, and maintaining an optical density during durability printing.

[Other Components]

The toner of the present invention may further properly contain in the toner matrix particles an additive such as a magnetic powder, a fluidity improver, an electric conductivity modifier, an extender, a reinforcing filler such as a fibrous substance, an antioxidant, an anti-aging agent and a cleanability improver.

<Method for Producing Toner Matrix Particles>

The toner matrix particles of the present invention may be particles obtained by any of conventionally known methods such as a melt-kneading method, an emulsion aggregation method, and a polymerization method, and pulverized toner matrix particles produced by the melt-kneading method are preferred, from the viewpoint of improving productivity and colorant dispersibility. Specifically, the toner matrix particles can be produced by homogeneously mixing raw materials such as a resin binder, a colorant, a charge control agent and a releasing agent with a mixer such as a Henschel mixer, thereafter melt-kneading the mixture with a closed kneader, a single-screw or twin-screw extruder, or an open-roller kneader, cooling, pulverizing, and classifying the product. On the other hand, the toner matrix particles produced by the polymerization method or the emulsion aggregation method are preferred from the viewpoint of the production of toners having smaller particle sizes.

<Volume-Median Particle Size of Toner Matrix Particles>

The toner matrix particles have a volume-median particle size ($D_{50}$) of preferably from 3 to 15 μm, more preferably from 4 to 12 μm, and even more preferably from 6 to 9 μm, from the viewpoint of improving image quality of the toner. Here, the term "volume-median particle size ($D_{50}$)" as used herein refers to a particle size of which cumulative volume frequency calculated on a volume percentage is 50% counted from the smaller particle sizes.

<External Additive>

The external additive in the present invention contains an external additive A.

<External Additive A>

The external additive A is composite oxide particles made of titania and silica. The external additive A may contain a substance other than titania and silica within the range that would not impair the effects of the present invention. The titania and the silica are contained in a total amount of preferably 95% by weight or more, more preferably 97% by weight or more, even more preferably 99% by weight or more, and even more preferably substantially 100% by weight, of the external additive A, from the viewpoint of suppressing the photoconductor abrasion of the toner during durability printing, and maintaining an optical density. Here, in a case where the composite oxide particles are subjected to a hydrophobic treatment mentioned later, the total amount of the titania and the silica contained is an amount contained in the composite oxide particles before the hydrophobic treatment.

The external additive A has a core-shell structure in which a core portion is made of titania, and a shell portion is made of silica, from the viewpoint of controlling a volume resistance of an external additive A to be lower than a volume resistance of the silica, and suppressing the deposition to a surface of the photoconductor due to electrostatic interactions of the toner, from the viewpoint of facilitating a hydrophobic treatment of the particle surface of the external additive A, and also suppressing the deposition to a surface of the photoconductor due to intermolecular interactions of the toner, from the viewpoint of controlling a volume resistance of the external additive A to be higher than a volume resistance of the titania, and suppressing the background fogging of the toner, consequently from the viewpoint of suppressing the photoconductor abrasion of the toner during durability printing, and from the viewpoint of providing a sharper distribution of triboelectric charges of the toner, and improving triboelectric stability, thereby consequently maintaining an optical density of the toner during durability printing. The core portion may contain a substance other than the titania within the range that would not impair the effects of the present invention, and it is preferable that titania is contained in an amount of substantially 100% by weight. The shell portion may contain a substance other than the silica within the range that would not impair the effects of the present invention, and it is preferable that silica is contained in an amount of substantially 100% by weight.

The titania is contained in an amount of 95% by weight or less, preferably 92% by weight or less, and more preferably 90% by weight or less, of the external additive A, from the viewpoint of being able to evenly coat a core portion with a shell portion, and consequently from the viewpoint of suppressing the photoconductor abrasion of the toner during durability printing, and maintaining an optical density. In addition, the titania is contained in an amount of 75% by weight or more, preferably 78% by weight or more, and more preferably 80% by weight or more, of the external additive A, from the viewpoint of enabling the external additive A to construct a core-shell structure, thereby consequently suppressing the photoconductor abrasion of the toner during durability printing, and maintaining an optical density. From these viewpoints taken together, the titania is contained in an amount of from 75 to 95% by weight, preferably from 78 to 92% by weight, and more preferably from 80 to 90% by weight, of the external additive A. Here, in a case where the composite oxide particles are subjected to a hydrophobic treatment described later, the amount of the titania contained is an amount contained in the composite oxide particles before the hydrophobic treatment.

The silica is contained in an amount of preferably 5% by weight or more, more preferably 8% by weight or more, and even more preferably 10% by weight or more, of the external additive A, from the viewpoint of being able to evenly coat a core portion with a shell portion, and consequently from the viewpoint of suppressing the photoconductor abrasion of the toner during durability printing, and maintaining an optical density. In addition, the silica is contained in an amount of preferably 25% by weight or less, more preferably 22% by weight or less, and even more preferably 20% by weight or less, of the external additive A, from the viewpoint of enabling the external additive A to construct a core-shell structure, thereby consequently suppressing the photoconductor abrasion of the toner during durability printing, and maintaining an optical density. From these viewpoints taken together, the silica is contained in an amount of preferably from 5 to 25% by weight, more preferably from 8 to 22% by weight, and even more preferably from 10 to 20% by weight, of the external additive A. Here, in a case where the composite oxide particles are subjected to a hydrophobic treatment described later, the amount of the silica contained is an amount contained in the composite oxide particles before the hydrophobic treatment.

The external additive A has an average primary particle size of preferably 10 nm or more, and more preferably 15 nm or more, from the viewpoint of preventing embedment of the external additive A into the toner, thereby consequently suppressing the photoconductor abrasion during durability printing, and maintaining an optical density. In addition, the external additive A has an average primary particle size of preferably 50 nm or less, and more preferably 40 nm or less, from the viewpoint of evenly coating the surface of a toner, and improving triboelectric stability of a toner, thereby consequently suppressing the photoconductor abrasion of the toner during durability printing, and maintaining an optical density. From these viewpoints taken together, the external additive A has an average primary particle size of preferably from 10 to 50 nm, and more preferably from 15 to 40 nm. The average primary particle size can be obtained by a method described in Examples set forth below.

In the external additive A, it is preferable that the surface of the particles is subjected to a hydrophobic treatment, from the viewpoint of suppressing the photoconductor abrasion of the toner during durability printing, and maintaining an optical density.

Since the external additive A has a core-shell structure in which the silica is a shell layer, a more even hydrophobic treatment can be carried out with the external additive A, as compared to that with composite oxide particles made of titania and silica having a non-core-shell structure in which titania exists on the surface, whereby consequently the photoconductor abrasion of the toner during durability printing can be suppressed, and an optical density can be maintained.

The hydrophobic treatment agent includes organochlorosilanes, such as dimethyldichlorosilane (DMDS); organoalkoxysilanes, such as octyltriethoxysilane (OTES) and methyltriethoxysilane; organodisilazanes, such as hexamethyldisilazane (HMDS); cyclic organopolysilazanes; linear organopolysiloxanes such as silicone oils and the like.

Among them, the organodisilazanes are preferred, and hexamethyldisilazane is more preferred, from the viewpoint of enabling uniform hydrophobic treatment.

The external additive A is contained in an amount of preferably 0.1 parts by weight or more, more preferably 0.2 parts by weight or more, even more preferably 0.3 parts by weight or more, and even more preferably 0.4 parts by weight or more, based on 100 parts by weight of the toner matrix particles, from the viewpoint of suppressing the photoconductor abrasion of the toner during durability printing and maintaining an optical density of a toner. In addition, the external additive A is contained in an amount of preferably 3 parts by weight or less, more preferably 1.5 parts by weight or less, even more preferably 1.2 parts by weight or less, even more preferably 1.0 part by weight or less, even more preferably 0.7 parts by weight or less, and even more preferably 0.6 parts by weight or less, based on 100 parts by weight of the toner matrix particles, from the viewpoint of suppressing the photoconductor abrasion of the toner during durability printing. From these viewpoints taken together, the external additive A is contained in an amount of preferably from 0.1 to 3 parts by weight, more preferably from 0.1 to 1.5 parts by weight, even more preferably from 0.2 to 1.2 parts by weight, even more preferably from 0.2 to 1.0 part by weight, even more preferably from 0.3 to 0.7 parts by weight, and even more preferably from 0.4 to 0.6 parts by weight, based on 100 parts by weight of the toner matrix particles.

The external additive A can be prepared in accordance with, for example, a method described in JP-A-2006-511638 or JP-A-Hei-11-193354, or the like.

For example, the external additive A is obtained by introducing silicon tetrachloride gas and titanium tetrachloride gas into a mixing chamber equipped with a combustion burner together with an inert gas, mixing hydrogen and the air to provide a mixed gas with a given ratio, combusting this mixed gas in a reaction chamber at 1000° to 3000° C. to form a composite oxide, cooling a reaction product, and collecting the product with a filter.

Alternatively, the external additive A can be also obtained by preparing a fine titanium oxide particle dispersion using a disperser in an alcohol solvent, thereafter sequentially adding an alkoxysilane compound, an alcohol, an aqueous ammonia, the above dispersion, and further water while mixing, carrying out hydrolysis of an alkoxide at 80° C., depositing a silica layer on the surface of fine titanium oxide particle, and thereafter filtering, washing, drying and pulverizing the product.

The hydrophobic treatment is carried out by, for example, spraying a liquid mixture previously prepared by diluting a necessary amount of a hydrophobic treatment agent in a solvent while stirring a raw composite oxide material in a mixing vessel at room temperature, raising the temperature inside the vessel while further continue stirring the raw composite oxide material, stirring for a given time period, and thereafter cooling the product.

Specific examples of the external additive A include STX801, STX501 (hereinabove, commercially available from Nippon Aerosol Co., Ltd.), FUJI TiO2-SDS (commercially available from Fuji Pigment Co., Ltd.), and the like.

<Other Additives>

The toner of the present invention may contain an external additive other than the external additive A.

The external additive other than the external additive A (hereinafter referred to as "external additive B") includes fine inorganic particles made of silica, alumina, titania, zirconia, tin oxide, zinc oxide, and the like. Among them, a silica having a small specific gravity is preferred, from the viewpoint of further suppressing the photoconductor abrasion of the toner during durability printing, and maintaining an optical density by their combined use with the external additive A.

It is preferable that the silica is a hydrophobic silica which is hydrophobically treated, from the viewpoint of suppressing the photoconductor abrasion of the toner during durability printing, and maintaining an optical density. A method for hydrophobic treatment is not particularly limited. The hydrophobic treatment agent includes hexamethyldisilazane (HMDS), dimethyldichlorosilane (DMDS), silicone oils, methyltriethoxysilane, and the like. Among them, hexamethyldisilazane and dimethyldichlorosilane are preferred, from the viewpoint of being capable of carrying out hydrophobic treatment uniformly. The treatment amount of the hydrophobically treating agent is preferably from 1 to 7 $mg/m^2$, per surface area of the fine inorganic particles.

The external additive B has an average primary particle size of preferably 10 to 100 nm, from the viewpoint of suppressing the embedment of the external additive to the toner matrix particles, and suppressing the release of the external additive from the toner matrix particles. Further, the external additive B has an average primary particle size of more preferably from 10 to 30 nm, and even more preferably from 10 to 20 nm, from the viewpoint of suppressing the photoconductor abrasion of the toner during durability printing, and maintaining an optical density.

It is preferable to use in combination of one or more kinds of an external additive having an average primary particle size of 10 to 30 nm (an external additive B1) and one or more kinds of an external additive having an average primary particle size of exceeding 30 nm and 100 nm or less (an external additive B2), from the viewpoint of suppressing the photoconductor abrasion of the toner during durability printing, and maintaining an image density. The external additive B1 and the external additive B2 are in a weight ratio, i.e. an external additive B1/an external additive B2, is preferably from 1/10 to 10/1, more preferably from 1/5 to 5/1, and even more preferably from 1/2 to 2/1.

The external additive B1 is contained in an amount of preferably 0.05 parts by weight or more, more preferably 0.1 parts by weight or more, even more preferably 0.2 parts by weight or more, and even more preferably 0.3 parts by weight or more, based on 100 parts by weight of the toner matrix particles, from the viewpoint of suppressing the photoconductor abrasion of the toner during durability printing, and maintaining an optical density. In addition, the external additive B1 is contained in an amount of preferably 3 parts by weight or less, more preferably 1.5 parts by weight or less, even more preferably 1.0 part by weight or less, and even more preferably 0.7 parts by weight or less, based on 100 parts by weight of the toner matrix particles, from the viewpoint of suppressing the photoconductor abrasion of the toner during durability printing. From these viewpoints taken together, the external additive B1 is contained in an amount of preferably from 0.05 to 3 parts by weight, more preferably from 0.1 to 1.5 parts by weight, even more preferably from 0.2 to 1.0 part by weight, and even more preferably from 0.3 to 0.7 parts by weight, based on 100 parts by weight of the toner matrix particles.

The external additive B2 is contained in an amount of preferably 0.05 parts by weight or more, more preferably 0.1 parts by weight or more, even more preferably 0.2 parts by weight or more, and even more preferably 0.3 parts by weight or more, based on 100 parts by weight of the toner matrix particles, from the viewpoint of suppressing the photoconductor abrasion of the toner during durability printing, and maintaining an optical density. In addition, the external additive B2 is contained in an amount of preferably 3 parts by weight or less, more preferably 1.5 parts by weight or less, even more preferably 1.0 part by weight or less, and even more preferably 0.7 parts by weight or less, based on 100 parts by weight of the toner matrix particles, from the viewpoint of suppressing the photoconductor abrasion of the toner during durability printing. From these viewpoints taken together, the external additive B2 is contained in an amount of preferably from 0.05 to 3 parts by weight, more preferably from 0.1 to 1.5 parts by weight, even more preferably from 0.2 to 1.0 part by weight, and even more preferably from 0.3 to 0.7 parts by weight, based on 100 parts by weight of the toner matrix particles.

The external additive B is contained in an amount, in other words, the external additive B1 and the external additive B2 are contained in a total amount, of preferably 0.1 parts by weight or more, more preferably 0.2 parts by weight or more, even more preferably 0.4 parts by weight or more, and even more preferably 0.6 parts by weight or more, based on 100 parts by weight of the toner matrix particles, from the viewpoint of suppressing the photoconductor abrasion of the toner during durability printing and maintaining an optical density. In addition, the external additive B is contained in an amount of preferably 6 parts by weight or less, more preferably 3 parts by weight or less, even more preferably 2 parts by weight or less, and even more preferably 1.5 parts by weight or less, based on 100 parts by weight of the toner matrix particles, from the viewpoint of suppressing the photoconductor abrasion of the toner during durability printing. From these viewpoints taken together, the external additive B is contained in an amount of preferably from 0.1 to 6 parts by weight, more preferably from 0.2 to 3 parts by weight, even more preferably from 0.4 to 2 parts by weight, and even more preferably from 0.6 to 1.5 parts by weight, based on 100 parts by weight of the toner matrix particles.

As the external additive B, it is preferable that a hydrophobically treated silica having an average primary particle size of from 10 to 30 nm and a hydrophobically treated silica having an average primary particle size of exceeding 30 nm and 100 nm or less are used in combination, from the viewpoint of suppressing the photoconductor abrasion of the toner during durability printing, and maintaining an optical density. As to the amount of each silica contained, it is preferable that each silica is used in an amount of from 0.6 to 1.5 parts by weight, based on 100 parts by weight of the toner matrix particles. In addition, it is preferable that each of the silicas is in a weight ratio, i.e. a hydrophobically treated silica having an average primary particle size of from 10 to 30 nm/a hydrophobically treated silica having an average primary particle size of exceeding 30 nm and 100 nm or less, of from 1/2 to 2/1.

The external additive A and the external additive B are contained in a total amount of preferably 0.2 parts by weight or more, more preferably 0.5 parts by weight or more, even more preferably 1.0 part by weight or more, even more preferably 1.2 parts by weight or more, and even more preferably 1.4 parts by weight or more, based on 100 parts by weight of the toner matrix particles, from the viewpoint of suppressing the photoconductor abrasion of the toner during durability printing and maintaining an optical density. In addition, the external additive A and the external additive B are contained in a total amount of preferably 6 parts by weight or less, more preferably 3 parts by weight or less, even more preferably 2 parts by weight or less, even more preferably 1.8 parts by weight or less, and even more preferably 1.6 parts by weight or less, based on 100 parts by weight of the toner matrix particles, from the viewpoint of suppressing the photoconductor abrasion of the toner during durability printing. From these viewpoints taken together, the external additive A and the external additive B are contained in a total amount of preferably from 0.2 to 6 parts by weight, more preferably from 0.5 to 3 parts by weight, even more preferably from 1.0 to 2 parts by weight, even more preferably from 1.2 to 1.8 parts by weight, and even more preferably from 1.4 to 1.6 parts by weight, based on 100 parts by weight of the toner matrix particles.

<Ratio of External Additive A/External Additive B>

The external additive A and the external additive B are contained in a weight ratio based on 100 parts by weight of the resin binder, i.e. external additive A/external additive B, of preferably 0.1 or more, more preferably 0.2 or more, even more preferably 0.3 or more, and even more preferably 0.4 or more, from the viewpoint of suppressing the photoconductor abrasion of the toner during durability printing, and maintaining an optical density. The external additive A and the external additive B are contained in a weight ratio of preferably 1.5 or less, more preferably from 1.2 or less, even more preferably 1.0 or less, even more preferably 0.8 or less, and even more preferably 0.6 or less, from the viewpoint of suppressing the photoconductor abrasion of the toner during durability printing. From these viewpoints taken together, the external additive A and the external additive B are contained in a weight ratio, i.e. the external additive A/the external additive B, of preferably from 0.1 to 1.5, more preferably from 0.1 to 1.2, even more preferably from 0.2 to 1.0, even more preferably from 0.3 to 0.8, and even more preferably from 0.4 to 0.6.

<Product of Content of Carbon Black and Content of External Additive A>

In a case where a carbon black is used as a colorant, if the carbon black is contained in a large amount, triboelectric charges are more likely to be lowered, so that background fogging is likely to take place, thereby making it possible to generate the photoconductor abrasion. Therefore, in order to suppress the photoconductor abrasion, it is preferable that triboelectric charges are optimally adjusted by using an external additive A which serves to maintain high triboelectric charges, and it is preferable to optimally control the contents of the carbon black and the external additive A.

A product of the content of the external additive A based on 100 parts by weight of the resin binder and the content of the carbon black based on 100 parts by weight of the resin binder, i.e. External Additive A×Carbon Black, is preferably 1 or more, more preferably 2 or more, even more preferably 2.7 or more, even more preferably 3 or more, and even more preferably 3.5 or more, from the viewpoint of suppressing the photoconductor abrasion of the toner during durability printing, and maintaining an optical density. In addition, the product of the content of the external additive A based on 100 parts by weight of the resin binder and the content of the carbon black based on 100 parts by weight of the resin binder is preferably 10 or less, more preferably 9 or less, even more preferably 8 or less, even more preferably 5 or less, even more preferably 4.5 or less, and even more preferably 4 or less, from the viewpoint of suppressing the photoconductor abrasion of the toner during durability printing. From these viewpoints taken together, a product of the content of the external additive A based on 100 parts by weight of the resin binder and the content of the carbon black based on 100 parts by weight of the resin binder, i.e. External additive A×Carbon black, is preferably from 1 to 10, more preferably from 2 to 9, even more preferably from 2 to 8, even more preferably from 2.7 to 8, even more preferably from 2.7 to 5, even more preferably from 3 to 5, even more preferably from 3.5 to 4.5, and even more preferably from 3.5 to 4.

<Step of Treating with External Additive>

In the mixing of the toner matrix particles with an external additive, a mixer equipped with a stirring tool such as rotary impellers is preferably used, and a High-Speed mixer such as a Henschel mixer or Super Mixer is preferred, and a Henschel mixer is more preferred.

The external additive A and the external additive B may be previously mixed and added to a High-Speed mixer or a V-type blender, or the external additive A and the external additive B may be separately added.

The peripheral speed of the mixer is preferably from 20 to 45 m/sec, and more preferably from 25 to 40 m/sec, from the viewpoint of controlling release of an external additive without being deposited to the toner matrix particles and controlling embedment of an external additive to the toner matrix particles.

<Method of Forming Fixed Images>

The toner of the present invention is capable of suppressing the photoconductor abrasion of the toner during durability printing, and maintaining an optical density of the toner, even when used in a method of forming fixed images using an apparatus for forming fixed images according to a non-contact fusing method, such as oven fusing or flash fusing. Therefore, the toner can be suitably used in an apparatus for forming fixed images according to a non-contact fusing method using a high speed having a linear speed of 800 mm/sec or more, and preferably from 1000 to 3000 mm/sec. Here, the term "linear speed" refers to a processing speed for an apparatus for forming fixed images, which is determined by a paper-feeding speed at a fixing member.

In addition, a method for development of the toner of the present invention is not particularly limited, and the toner can also be suitably used for a method of forming fixed images using an apparatus for forming fixed images according to a hybrid development method, from the viewpoint of suppressing the photoconductor abrasion of the toner during durability printing, and maintaining an optical density. The toner can also be suitably used in an apparatus for forming fixed images according to a hybrid development method using a high speed having a linear speed of 800 mm/sec or more, and preferably from 1000 to 3000 mm/sec.

Here, the hybrid development method is described in *Journal of the Imaging Society of Japan,* 49(2), 102-107 (2010), in which a toner is charged with a carrier in a two-component developer, and the charged toner is transferred from the two-component developer transported with a magnetic roller to a developer roller due to a potential difference between the magnetic roller and the developer roller, and the toner is then transferred from the developer roller to a latent image member of the photoconductor, whereby the development is carried out while the developer roller and the photoconductor are kept in a non-contact state.

The toner of the present invention can be directly used as a toner for monocomponent development, or mixed with a carrier to provide a two-component developer. The toner is suitably used in an apparatus for forming fixed images according to a nonmagnetic development method, especially a nonmagnetic two-component development method, from the viewpoint of obtaining stable triboelectric chargeability under stirring conditions with a carrier.

Therefore, the toner of the present invention can also be suitably used in a method of forming fixed images using an apparatus for forming fixed images using a high speed, according to a nonmagnetic two-component development method and a hybrid development method.

<Two-Component Developer>

[Carrier]

In the present invention, as the carrier, a carrier having a low saturation magnetization which has a weaker contact with a magnetic brush is preferable, from the viewpoint of the image properties. The carrier has a saturation magnetization of preferably from 40 to 100 $Am^2/kg$, and more preferably from 50 to 90 $Am^2/kg$. The carrier has a saturation magnetization of preferably 100 $Am^2/kg$ or less, from the viewpoint of controlling the hardness of the magnetic brush and retaining the tone reproducibility of images, and the carrier has a saturation magnetization of preferably 40 $Am^2/kg$ or more, from the viewpoint of preventing the carrier from being adhered and toner dust.

A carrier comprises a core material and a coating material.

[Core Material for Carrier]

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, and copper-zinc-magnesium ferrite is more preferable, from the viewpoint of improving triboelectric stability of a toner, suppressing the photoconductor abrasion of the toner during durability printing, and maintaining an optical density.

[Coating Material for Carrier]

The surface of the carrier may be coated with a resin, from the viewpoint of preventing the formation of toner scumming on the carrier. The resin for coating the surface of the carrier may vary depending upon the raw materials for toners to be used together, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. The silicone resin are preferred, from the viewpoint of improving triboelectric stability of a toner, suppressing the photoconductor abrasion of the toner during durability printing, and maintaining an optical density. These resins can be used alone or in a combination of two or more kinds.

The method of coating a core material with a resin is not particularly limited, and includes, for example, a method of dissolving or suspending a coating material such as a resin in a solvent, and applying the solution or suspension to be deposited on a core material, a method of blending a resin powder and a core material to be deposited on a core material, and the like.

[Mixing Ratio of Toner and Carrier]

In a two-component developer obtained by mixing a toner with a carrier, the toner is contained in an amount of preferably 2% by weight or more, more preferably 3% by weight or more, and even more preferably 4% by weight or more, of the two-component developer, from the viewpoint of preventing embedment of an external additive into a toner, suppressing the photoconductor abrasion of the toner during durability printing, and maintaining an optical density. In addition, the toner is contained in an amount of preferably 10% by weight or less, more preferably 9% by weight or less, and even more preferably 8% by weight or less, of the two-component developer, from the viewpoint of improving triboelectric stability of a toner, suppressing the photoconductor abrasion of the toner during durability printing, and maintaining an optical density. From these viewpoints taken together, the toner is contained in an amount of preferably from 2 to 10% by weight, more preferably from 3 to 9% by weight, and even more preferably from 4 to 8% by weight, of the two-component developer.

EXAMPLES

The following examples further describe and demonstrate embodiments of the present invention. The examples are given solely for the purposes of illustration and are not to be construed as limitations of the present invention.

[Softening Points of Resins]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Glass Transition Temperatures of Resins]

Measurements were taken using a differential scanning calorimeter ("Q-100," commercially available from TA Instruments, Japan), by heating a 0.01 to 0.02 g sample weighed out in an aluminum pan to 200° C., cooling the sample from that temperature to 0° C. at a cooling rate of 10° C./min, and raising the temperature of the sample at a rate of 10° C./min. A temperature of an intersection of the extension of the baseline of equal to or lower than the temperature of maximum endothermic peak and the tangential line showing the maximum inclination between the kick-off of the peak and the top of the peak is defined as a glass transition temperature.

[Acid Values of Resins]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Melting Point of Releasing Agent]

A temperature of maximum endothermic peak of the heat of fusion obtained by raising the temperature of a sample to 200° C., cooling the sample from this temperature to 0° C. at a cooling rate of 10° C./min, and thereafter raising the temperature of the sample at a heating rate of 10° C./min, using a differential scanning calorimeter ("DSC 210," commercially available from Seiko Instruments, Inc.) is referred to as a melting point.

[Average Primary Particle Size of External Additive]

Particle sizes were determined for 500 particles from a photograph taken with a scanning electron microscope (SEM), an average of length and breadth of the particles of which is taken, and the average is referred to as an average primary particle size.

[Volume-Median Particle Size ($D_{50}$) of Toner]

Measuring Apparatus: Coulter Multisizer II (commercially available from Beckman Coulter, Inc.)

Aperture Diameter: 100 μm

Analyzing Software: Coulter Multisizer AccuComp Ver. 1.19 (commercially available from Beckman Coulter, Inc.)

Electrolytic solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

[Saturation Magnetization of Carrier]

(1) A carrier is filled in a plastic case with a lid with tapping, the case having an outer diameter of 7 mm (inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, while vibrating the plastic case using the vibration function. The value obtained is calculated as the saturation magnetization per unit mass, taking into consideration the mass of the filled carrier.

Production Examples of External Additives

Production Example 1 of External Additives [External Additives a3 to a5]

In accordance with the methods described in Examples 1 to 7 of JP-A-2003-104712, external additives a3 to a5 were produced by a method described below.

Hexamethyldisilazane and tetraisopropoxytitanium (colorless liquid) were mixed in a weight ratio of the two components as shown in Table 1, to provide a raw material solution. This raw material solution was fed to a burner provided at a top of a vertical combustion furnace at room temperature, and a spraying medium nitrogen was sprayed thereto in fine liquid droplets from spraying nozzles provided at a tip end of the burner, to allow combustion according to propane combustion with a flame booster. Oxygen and nitrogen were fed from the burner as combustion supporting gases. A mixed composition of hexamethyldisilazane and tetraisopropoxytitanium at this time, and feeding rates of a raw material solution, propane, oxygen, the air, and spraying nitrogen are listed in Table 1. The formed silica/titania composite oxide in the form of spherical powder was collected with a jet-stream classifier and a bag filter, to provide composite oxide particles having a non-core-shell structure. A 5-liter planetary mixer was charged with 1 kg of the resulting composite oxide particles, and 10 g of pure water was added thereto while stirring. After tightly sealing the mixer, the components were further stirred at 60° C. for 10 hours. Next, the mixture was cooled to room temperature, and 20 g of hexamethyldisilazane was then added thereto while stirring. After tightly sealing the mixer, the components were stirred for additional 24 hours. After raising the temperature to 120° C., the residual raw materials and formed ammonia were removed while aerating with nitrogen gas, to provide each of external additives a3 to a5.

TABLE 1

| | External Additive a3 | External Additive a4 | External Additive a5 |
|---|---|---|---|
| Compositional Ratio (Weight Ratio) of Raw Materials | | | |
| Hexamethyldisilazane | 95 | 88 | 95 |
| Tetraisopropoxytitanium | 5 | 12 | 5 |
| Feeding Rates | | | |
| Raw Material Solution (kg/hr) | 7.0 | 6.0 | 6.5 |
| Propane ($Nm^3$/hr) | 0.15 | 0.20 | 0.15 |
| Oxygen ($Nm^3$/hr) | 20.0 | 15.0 | 20.0 |
| Air ($Nm^3$/hr) | 10.0 | 15.0 | 10.0 |
| Sprayed Nitrogen ($Nm^3$/hr) | 2.1 | 2.0 | 2.1 |
| Formed Compositional Ratio (Weight Ratio) | | | |
| Silica | 98 | 95 | 98 |
| Titania | 2 | 5 | 2 |
| Average Primary Particle Size (nm) of Titania/Silica Composite Particles | 295 | 295 | 68 |

The physical properties of the external additives used in Examples and Comparative Examples are shown in Table 2.

TABLE 2

| | $SiO_2/TiO_2$ Ratio | $TiO_2$ Content*5 (% by wt.) | Form | Average Primary Particle Size (nm) | Surface Treatment Agent |
|---|---|---|---|---|---|
| External Additive A1*1 | 15/85 | 85 | Core-Shell Form | 18 | Hexamethyldisilazane |
| External Additive A2*2 | 5/95 | 95 | Core-Shell Form | 22 | Hexamethyldisilazane |
| External Additive a3 | 98/2 | 2 | Non-Core-Shell Form | 295 | Hexamethyldisilazane |
| External Additive a4 | 95/5 | 5 | Non-Core-Shell Form | 295 | Hexamethyldisilazane |
| External Additive a5 | 98/2 | 2 | Non-Core-Shell Form | 68 | Hexamethyldisilazane |
| External Additive a6*3 | 0/100 | 100 | — | 15 | Isobutylmethoxysilane |

TABLE 2-continued

| | $SiO_2/TiO_2$ Ratio | $TiO_2$ Content*5 (% by wt.) | Form | Average Primary Particle Size (nm) | Surface Treatment Agent |
|---|---|---|---|---|---|
| External Additive a7*4 | 15/85 | — | Mixture of $SiO_2$ Particles and $TiO_2$ Particles | 20/15*6 | Hexamethyldisilazane/ Isobutylmethoxysilane*7 |

*1Composite oxide particles STX-801 (commercially available from Nippon Aerosil Co., Ltd.)
*2Composite oxide particles STX-501 (commercially available from Nippon Aerosil Co., Ltd.)
*3Titania JMT-150IB (commercially available from Tayca Corporation)
*4Mixture of Silica NX90G (commercially available from Nippon Aerosil Co., Ltd.) and Titania JMT-150IB (commercially available from Tayca Corporation)
*5$TiO_2$ content in composite oxide particles before hydrophobic treatment
*6Average primary particle size of $SiO_2$ particles/average primary particle size of $TiO_2$ particles
*7Hydrophobic Treatment Agent for $SiO_2$ particles/Hydrophobic Treatment Agent for $TiO_2$ particles

Production Examples of Resins

Production Example 1 of Resins [Resins A and B]

A 5-liter four-neck flask equipped with a nitrogen inlet tube, a dehydration tube, a stirrer, and a thermocouple was charged with raw material monomers as listed in Table 3 and 19.5 g of an esterification catalyst (dibutyltin oxide), and the temperature was raised to 230° C. The contents were reacted until a reaction rate of 90% was reached, and further reacted at 8.3 kPa for 1 hour, to provide each of a resin A and a resin B. The physical properties of the resins A and B are shown in Table 3. Here, the reaction rate in the present invention refers to a value calculated by [amount of water generated (mol)/ theoretical amount of water generated (mol)]×100.

Production Example 2 of Resin [Resin C]

A 5-liter four-neck flask equipped with a nitrogen inlet tube, a dehydration tube, a stirrer, and a thermocouple was charged with raw material monomers as listed in Table 3, 19.5 g of an esterification catalyst (dibutyltin oxide), and 2 g of a polymerization inhibitor (hydroquinone), and the temperature was raised to 230° C. The contents were reacted until a reaction rate of 90% was reached, and further reacted at 8.3 kPa for 1 hour, to provide a resin C. The physical properties of the resin C are shown in Table 3.

TABLE 3

| | Resin A | Resin B | Resin C |
|---|---|---|---|
| BPA-PO1) | 980 g(35) | 980 g(35) | 2688 g(100) |
| BPA-EO2) | 1690 g(65) | 1690 g(65) | — |
| Fumaric Acid | — | — | 929 g(104) |
| Terephthalic Acid | — | 1223 g(92) | — |
| Isophthalic Acid | 1223 g(92) | — | — |
| Content of Isophthalic Acid Compound in Total Amount of Raw Material Monomers (% by weight) | 31.4 | 0 | 0 |
| Softening Point (° C.) | 110 | 103 | 102 |
| Glass Transition Temperature (° C.) | 64 | 62 | 62 |
| Acid Value (mgKOH/g) | 3.2 | 18 | 19 |

Values inside the parentheses ( ) show a molar ratio, supposing that a total molar ratio of the alcohol component in a condensed resin is 100.
1)BPA-PO: Polyoxypropylene(2.2)-2,2-bis(4-hydroxyphenyl)propane
2)BPA-EO: Polyoxyethylene(2.2)-2,2-bis(4-hydroxyphenyl)propane

Production Examples of Toners

Examples 1 and 3-13 and Comparative Examples 1, 2, 4-8

A resin binder and a colorant in given amounts shown in Table 4, 2 parts by weight of a negatively chargeable charge control agent "metal-containing azo dye T-77" (commercially available from Hodogaya Chemical Co., Ltd.), and 2 parts by weight of a releasing agent "Carnauba Wax No. 1" (commercially available from S. Kato & CO., melting point: 81° C.) were mixed with a Henschel mixer for 210 seconds, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 6 minutes.

The kneaded product obtained above was cooled to 20° C. or lower while pressing with a cooling roller to, and the cooled melt-kneaded product was roughly pulverized to a size of 3 mm with Rotoplex (commercially available from TOA KIKAI SEISAKUSHO), and then pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.3 μm.

One-hundred parts by weight of the toner matrix particles were mixed with an external additive in a given amount shown in Table 4, 0.5 parts by weight of an external additive B1-1 "hydrophobic silica R972" (commercially available from Nippon Aerosil Co., Ltd., silica treated with dimethyldichlorosilane, average primary particle size: 16 nm), and 0.5 parts by weight of an external additive B2-1 "hydrophobic silica NAX50" (commercially available from Nippon Aerosil Co., Ltd., silica treated with hexamethyldisilazane, average primary particle size: 40 nm) with a 75-L Henschel mixer (commercially available from NIPPON COKE & ENGINEERING CO., LTD.) at 1500 r/min (38 m/sec) for 3 minutes, to provide a toner. Here, the upper blades on the Henschel mixer was ST form, and the lower blades were A0 form.

Example 2

The same procedures as in Example 1 were carried out except that as external additives an external additive B2-1 was not used, and the amount of an external additive B1-1 used was changed to 1.0 part by weight, in other words, external additives were changed to 0.5 parts by weight of the external additive A1 and 1.0 part by weight of the external additive B1-1 "hydrophobic silica R972," to provide a toner.

Example 14

The same procedures as in Example 1 were carried out except that as external additives an external additive B1-2 was used in place of the external additive B1-1, in other words, external additives were changed to 0.5 parts by weight of an external additive A1, 0.5 parts by weight of an external additive B1-2 "hydrophobic silica TS720" (commercially available from Cabot Corporation, silica treated with dimethyl silicone oil, average primary particle size: 12 nm), and 0.5 parts by weight of an external additive B2-1 "hydrophobic silica NAX50," to provide a toner.

Example 15

The same procedures as in Example 1 were carried out except that as external additives an external additive B2-2 was used in place of the external additive B2-1, in other words, external additives were changed to 0.5 parts by weight of an external additive A1, 0.5 parts by weight of an external additive B1-1 "hydrophobic silica R972," and 0.5 parts by weight of an external additive B2-2 "hydrophobic silica RY50 (commercially available from Nippon Aerosil Co., Ltd., silica treated with dimethyl silicone oil, average primary particle size: 40 nm)," to provide a toner.

Example 16

The same procedures as in Example 1 were carried out except that as external additives an external additive B2-1 was not used, in other words, external additives were changed to 0.5 parts by weight of the external additive A1 and 0.5 parts by weight of the external additive B1-1 "hydrophobic silica R972," to provide a toner.

Example 17

The same procedures as in Example 1 were carried out except that as external additives an external additive B1-1 was not used, in other words, external additives were changed to 0.5 parts by weight of the external additive A1 and 0.5 parts by weight of the external additive B2-1 "hydrophobic silica NAX50," to provide a toner.

Comparative Example 3

The same procedures as in Example 1 were carried out except that as external additives an external additive A1 was not used, and that external additives were changed to 1.0 part by weight of the external additive B1-1 and 0.5 parts by weight of the external additive B2-1, to provide a toner.

TABLE 4

| | Resin Binder | | | Content of Isophthalic Acid Compound in Total Amount of Raw | Colorant*1 | External Additive | | Product*4 of Content of Carbon Black × |
|---|---|---|---|---|---|---|---|---|
| | Resin A (Parts by Weight) | Resin B (Parts by Weight) | Resin C (Parts by Weight) | Material Monomers for All the Polyesters (% by weight) | Amount (Parts by Weight)*2 | Kind | Amount (Parts by Weight)*3 | Content of External Additive A |
| Ex. 1 | 100 | — | — | 31.4 | 7 | External Additive A1 | 0.5 | 3.9 |
| Ex. 2 | 100 | — | — | 31.4 | 7 | External Additive A1 | 0.5 | 3.9 |
| Ex. 3 | 100 | — | — | 31.4 | 7 | External Additive A2 | 0.5 | 3.9 |
| Ex. 4 | 50 | 50 | — | 15.7 | 7 | External Additive A1 | 0.5 | 3.9 |
| Ex. 5 | 20 | 80 | — | 6.3 | 7 | External Additive A1 | 0.5 | 3.9 |
| Ex. 6 | 50 | — | 50 | 15.7 | 7 | External Additive A1 | 0.5 | 3.9 |
| Ex. 7 | 20 | — | 80 | 6.3 | 7 | External Additive A1 | 0.5 | 3.9 |
| Ex. 8 | 100 | — | — | 31.4 | 7 | External Additive A1 | 0.3 | 2.3 |
| Ex. 9 | 100 | — | — | 31.4 | 7 | External Additive A1 | 0.8 | 6.2 |
| Ex. 10 | 100 | — | — | 31.4 | 7 | External Additive A1 | 1.2 | 9.3 |
| Ex. 11 | 100 | — | — | 31.4 | 9 | External Additive A1 | 0.5 | 5.1 |
| Ex. 12 | 100 | — | — | 31.4 | 5 | External Additive A1 | 0.5 | 2.7 |
| Ex. 13 | 100 | — | — | 31.4 | 9 | External Additive A1 | 0.4 | 4.1 |
| Ex. 14 | 100 | — | — | 31.4 | 7 | External Additive A1 | 0.5 | 3.9 |
| Ex. 15 | 100 | — | — | 31.4 | 7 | External Additive A1 | 0.5 | 3.9 |
| Ex. 16 | 100 | — | — | 31.4 | 7 | External Additive A1 | 0.5 | 3.9 |
| Ex. 17 | 100 | — | — | 31.4 | 7 | External Additive A1 | 0.5 | 3.9 |
| Comp. Ex. 1 | — | 100 | — | 0 | 7 | External Additive A1 | 0.5 | 3.9 |
| Comp. Ex. 2 | — | — | 100 | 0 | 7 | External Additive A1 | 0.5 | 3.9 |
| Comp. Ex. 3 | 100 | — | — | 31.4 | 7 | — | — | — |
| Comp. Ex. 4 | 100 | — | — | 31.4 | 7 | External Additive a3 | 0.4 | — |
| Comp. Ex. 5 | 100 | — | — | 31.4 | 7 | External Additive a4 | 0.4 | — |
| Comp. Ex. 6 | 100 | — | — | 31.4 | 7 | External Additive a5 | 0.4 | — |
| Comp. Ex. 7 | 100 | — | — | 31.4 | 7 | External Additive a6 | 0.4 | — |
| Comp. Ex. 8 | 100 | — | — | 31.4 | 7 | External Additive a7 | 0.4 ($SiO_2$ Particles: 0.06) ($TiO_2$ Particles: 0.34) | — |

*1Carbon black REGAL 330R (comm. available from Cabot Corp.)

*2Amount based on 100 parts by wt. of the resin binder

*3Amount based on 100 parts by wt. of toner matrix particles

*4Product of each content based on 100 parts by wt. of the resin binder

Test Example 1

Photoconductor Abrasion

Six parts by weight of the resulting toner and 94 parts by weight of a carrier "KK01-C35" (core material: copper-zinc-magnesium ferrite, coating material: silicone resin) (commercially available from Oce Printing Systems GmbH, volume-average particle size: 60 μm, saturation magnetization: 68 $Am^2/kg$) were mixed, to provide a two-component developer. The resulting two-component developer was loaded to an apparatus for forming fixed images according to a hybrid development method "Vario stream 9000" ⌋ (commercially available from Oce Printing Systems GmbH) equipped with an unused photoconductor, and printing was continuously conducted at a print coverage of 1%, a linear speed of 1,000 mm/sec for 5 hours. Thereafter, printing was conducted at a print coverage of 4.5% for 20 hours, then conducted at a print coverage of 9% for 20 hours, then at a print coverage of 1% for 20 hours, and further at a print coverage of 4.5% for 20 hours, printing totaling to 85 hours. The step height between a part not used in the development of a photoconductor (non-development part) and a part used in the development (development part) (an average of 10 sites arbitrarily selected) was measured, using a laser scanning surface roughness measurement instrument (Ultra-Deep Profile Measuring Microscope VK-8500, manufactured by KEYENCE Corporation), and used as an index for photoconductor abrasion. The larger the difference in step height, the larger the abrasion. Here, the measurement conditions for the Ultra-Deep Profile Measuring Microscope VK-8500 are as follows. The results are shown in Table 5.

Photoconductor sample: Set so that measurement can be taken in a direction perpendicular to the printing direction.

Lens magnification: 20×

Run Mode: white-black ultra-deep (auto gain)

Laser intensity: 200 to 220

Lens positions: an upper end (H) and a lower end (L) are set so that a non-developing part and a developing part are included in the same scope of field.

Test Example 2

Optical Density

Continuously printing was conducted in the same manner as in Test Example 1, and thereafter solid images having sizes 20 cm×20 cm were printed. Optical densities of a fixed image sample were measured at 5 points with a colorimeter "Gretag-Macbeth Spectroeye" (commercially available from X-Rite GmbH), and an average thereof was evaluated as optical density (OD). Here, during the measurement of optical density, the measurement of optical density was carried out in a mode in which a polarized plate is not sandwiched. The results are shown in Table 5.

TABLE 5

| | Abrasion (μm) of Photoconductor | Optical Density |
|---|---|---|
| Example 1 | 2.1 | 1.8 |
| Example 2 | 2.5 | 1.7 |
| Example 3 | 2.2 | 1.8 |
| Example 4 | 2.9 | 1.7 |
| Example 5 | 3.0 | 1.6 |
| Example 6 | 2.7 | 1.8 |
| Example 7 | 3.1 | 1.8 |

TABLE 5-continued

| | Abrasion (μm) of Photoconductor | Optical Density |
|---|---|---|
| Example 8 | 3.0 | 1.6 |
| Example 9 | 3.2 | 1.8 |
| Example 10 | 3.4 | 1.8 |
| Example 11 | 3.2 | 1.8 |
| Example 12 | 2.8 | 1.6 |
| Example 13 | 2.6 | 1.8 |
| Example 14 | 2.2 | 1.7 |
| Example 15 | 2.2 | 1.8 |
| Example 16 | 2.5 | 1.6 |
| Example 17 | 2.8 | 1.7 |
| Comparative Example 1 | 2.5 | 1.1 |
| Comparative Example 2 | 4.1 | 1.8 |
| Comparative Example 3 | 3.8 | 1.7 |
| Comparative Example 4 | 4.4 | 1.8 |
| Comparative Example 5 | 5.2 | 1.8 |
| Comparative Example 6 | 4.0 | 1.8 |
| Comparative Example 7 | 3.9 | 1.7 |
| Comparative Example 8 | 4.3 | 1.7 |

It can be seen from the above results that the toners of Examples 1 to 17 are excellent in both suppression of the photoconductor abrasion and optical density, as compared to the toners of Comparative Examples 1 to 8.

The toner for electrostatic image development and the two-component developer containing the toner of the present invention are suitably used in, for example, the development or the like of latent image formed in electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising toner matrix particles comprising at least a resin binder and a colorant, and an external additive, the external additive comprising composite oxide particles (an external additive A) that comprise titania and silica, wherein the external additive A comprises a core-shell structure in which a core portion comprises the titania and a shell portion comprises the silica, wherein the titania is present in the external additive A in an amount of from 75 to 95% by weight, the resin binder comprising a polyester obtained by polycondensing a carboxylic acid component comprising at least 55% by mol of an isophthalic acid compound, and an alcohol component (a polyester A), the colorant is a carbon black, which is present in an amount of from 3 to 15 parts by weight, based on 100 parts by weight of the resin binder, and a product of the amount in parts by weight of the external additive A contained based on 100 parts by weight of the resin binder and the amount in parts by weight of the carbon black contained based on 100 parts by weight of the resin binder is from 1 to 10.

2. The toner according to claim 1, wherein the polyester A is present in an amount of 15% by weight or more of the resin binder.

3. The toner according to claim 1, wherein the isophthalic acid compound is present in an amount of from 5 to 70% by weight of a total amount of all monomers of the polyesters in the resin binder.

4. The toner according to claim 1, wherein the external additive A is present in an amount of from 0.1 to 3 parts by weight, based on 100 parts by weight of the toner matrix particles.

5. The toner according to claim 1, wherein the titania is present in an amount of from 80 to 95% by weight of the external additive A.

6. The toner according to claim 1, wherein the isophthalic acid compound is present in an amount of from 25 to 34% by weight of a total amount of the raw material monomers of all the polyesters in the resin binder.

7. The toner according to claim 1, wherein a product of the amount in parts by weight of the external additive A contained based on 100 parts by weight of the resin binder and the amount in parts by weight of the carbon black contained based on 100 parts by weight of the resin binder is from 3 to 4.

8. The toner according to claim 1, wherein the polyester A is present in an amount of 95% by weight or more of the resin binder.

9. The toner according to claim 1, wherein the isophthalic acid compound is present in an amount of 90% by mol or more of the carboxylic acid component in the polyester A.

10. A two-component developer comprising a toner for electrostatic image development as defined in claim 1 and a carrier.

11. The two-component developer according to claim 10, wherein the core material for the carrier is copper-zinc-magnesium ferrite.

12. The two-component developer according to claim 10, wherein the coating material for the carrier is a silicone resin.

13. A method for forming fixed images comprising applying a toner for electrostatic image development as defined in claim 1 according to a non-contact fusing method.

14. The method according to claim 13, wherein paper is fed through a fixing member of an apparatus for carrying out said method at a linear speed of 800 mm/sec or more.

15. A method for forming fixed images comprising applying a two-component developer as defined in claim 10 according to a hybrid development method, wherein in said hybrid development method, the toner is charged with a carrier of said two-component developer, and the charged toner is transferred from the two-component developer transported with a magnetic roller to a developer roller due to a potential difference between the magnetic roller and the developer roller, and the toner is then transferred from the developer roller to a latent image member of a photoconductor, whereby the development is carried out while the developer roller and the photoconductor are kept in a non-contact state.

16. The method according to claim 15, wherein paper is fed through a fixing member of an apparatus for carrying out said method at a linear speed of 800 mm/sec or more.

* * * * *